US007392680B2

(12) United States Patent
Kinoshita et al.

(10) Patent No.: US 7,392,680 B2
(45) Date of Patent: Jul. 1, 2008

(54) ROLLING DIE AND METHOD FOR FORMING THREAD OR WORM AND SPLINE HAVING SMALL NUMBER OF TEETH BY ROLLING SIMULTANEOUSLY

(75) Inventors: Yasuo Kinoshita, Toyota (JP); Masahiko Higuchi, Nagano (JP); Yoshihiro Umebayashi, Toyokawa (JP)

(73) Assignees: Toyota Jidosha Kabushiki Kaisha, Aichi (JP); Hayashi Precision Co. Ltd, Tokyo (JP); OSG Corporation, Aichi (JP)

( * ) Notice: Subject to any disclaimer, the term of this patent is extended or adjusted under 35 U.S.C. 154(b) by 0 days.

(21) Appl. No.: 11/707,830

(22) Filed: Feb. 16, 2007

(65) Prior Publication Data

US 2007/0209419 A1 Sep. 13, 2007

(30) Foreign Application Priority Data

Feb. 20, 2006 (JP) ..... 2006-042404

(51) Int. Cl.
*B21D 17/04* (2006.01)

(52) U.S. Cl. ..... 72/88; 72/102; 72/469

(58) Field of Classification Search ..... 72/88, 72/90, 102, 104, 108, 469
See application file for complete search history.

(56) References Cited

U.S. PATENT DOCUMENTS

| | | | | |
|---|---|---|---|---|
| 3,857,273 | A * | 12/1974 | Miller et al. | 72/469 |
| 4,683,743 | A * | 8/1987 | Fitzpatrick | 72/88 |
| 4,771,623 | A * | 9/1988 | Killop | 72/88 |
| 4,829,800 | A * | 5/1989 | Killop | 72/108 |
| 6,250,123 | B1 * | 6/2001 | Killop | 72/88 |
| 2002/0062671 | A1 * | 5/2002 | Lee et al. | 72/108 |

FOREIGN PATENT DOCUMENTS

| | | |
|---|---|---|
| JP | 60-072630 | 4/1985 |
| JP | 04-187337 | 7/1992 |

* cited by examiner

*Primary Examiner*—Edward Tolan
(74) *Attorney, Agent, or Firm*—Muramatsu & Associates

(57) ABSTRACT

There is provided a rolling die and a method for forming a thread or worm and a spline having a small number of teeth whose number is thirteen or less simultaneously by rolling. By use of rolling dies, the formation of a worm by rolling by use of a thread rolling die starts, and after that, the formation of a spline having a small number of teeth by rolling starts by use of a spline rolling die while continuing the formation of the worm. Accordingly, a rolled material can be rolled forcibly by a driving source from the worm rolled using the thread rolling die. As a result, the spline having a small number of teeth whose number is thirteen or less can be formed by rolling onto the rolled material at the same time as the formation of the worm.

4 Claims, 4 Drawing Sheets

ROLLING DIE AND METHOD FOR FORMING THREAD OR WORM AND SPLINE HAVING SMALL NUMBER OF TEETH BY ROLLING SIMULTANEOUSLY

BACKGROUND OF THE INVENTION

1. Field of the Invention

The present invention relates to a rolling die and a method for forming a thread or worm and a spline having a small number of teeth by rolling simultaneously. More particularly, the present invention relates to a rolling die and a method for forming a thread or worm and a spline having a small number of teeth whose number is thirteen or less simultaneously by rolling.

2. Description of the Related Art

Generally, a shaft member having a thread or worm and a spline coaxially is formed by rolling using a thread rolling die for threads or worms and a spline rolling die for splines. The thread rolling die and spline rolling die are disposed to different positions laterally and linearly. In this rolling, the thread or worm and spline are formed by rolling at different timings. Accordingly, the rolling takes long time, and the rolling machine increases in size.

In recent years, for example, as disclosed in Japanese Examined Patent Application Publication No. H01-41419 (lines 20th to 22nd of the 4th column, FIGS. 3 to 6, etc.) and Japanese Patent No. 2902101 (lines 7th to 10th of the 5th column, FIGS. 1 to 4, etc.), a thread rolling die and a spline rolling die are disposed parallel to each other to form a thread or worm and spline simultaneously by rolling.

In the above conventional method, a spline having a small number of teeth whose number is thirteen or less cannot be formed by rolling together with a thread or worm.

In other words, when a small number of teeth are formed by rolling onto a rolled material to form a shape of a gear such as a spline (the number of teeth of the spline is thirteen or less), teeth of a rolling die can be out of contact with teeth of the rolled material. Accordingly, the rolled material cannot be rolled, disabling the rolling.

Conventionally, the spline having a small number of teeth needs to be formed by gear cutting (machining), while the thread or worm is formed by rolling. This is extremely inefficient.

On the other hand, there are a method (the so-called zigzag rolling) in which the spline having a small number of teeth is formed by rolling onto two portions out of phase by a half pitch, and a method in which a rolled material is rolled forcibly by use of a guide block for the rolling. The latter method is disclosed in Japanese Examined Patent Application Publication S60-187. In the former, one of the rolled splines needs to be cut and deleted. In the latter, a portion formed by rolling by use of the guide block needs to be cut and deleted. These are extremely inefficient.

SUMMARY OF THE INVENTION

For addressing the above disadvantage, an object of the present invention is to provide a rolling die and a method for forming a thread or worm and a spline having a small number of teeth whose number is thirteen or less onto a shaft member simultaneously by rolling.

To achieve this object, a rolling die of a first aspect of the present invention includes: a thread rolling die for forming a thread or warm by rolling onto a first rolled portion of a shaft member coaxially having the first rolled portion and a second rolled portion; and a spline rolling die for forming a spline having a small number of teeth whose number is thirteen or less onto a second rolled portion the shaft member by rolling. The thread rolling die and spline rolling die are disposed parallel to each other. Pitches of a set of teeth of the spline rolling die are set in accordance with a circumferential length of a rolling diameter of the thread or worm formed by rolling onto the first rolled portion of the shaft member by use of the thread rolling die. The cutting in the second rolled portion of the shaft member by use of the spline rolling die starts, when cutting in the first rolled portion of the shaft member by use of the thread rolling die is done so that a depth of the cutting in the first rolled portion reaches a value of five percent or more and ten percent or less relative to a blank diameter of the first rolled portion.

In the rolling die of a second aspect of the present invention according to the first aspect, the set of teeth of the thread rolling die and the set of the teeth of the spline rolling die include a roll-up section, a finish section, and a roll-off section, respectively. An end of the roll-up section of the spline rolling die is disposed between a start and end of the finish section of the thread rolling die.

In a third aspect of the present invention, a method for simultaneously forming a thread or worm and a spline having a small number of teeth whose number is thirteen or less onto a shaft member coaxially by rolling by use of a thread rolling die and a spline rolling die, includes the following steps are executed. Pitches of a set of teeth of the spline rolling die are set in accordance with a circumferential length of a rolling diameter of the thread or worm formed by rolling onto the shaft member by use of the thread rolling die. First, the thread or worm starts to be formed by rolling onto the first rolled portion of the shaft member by use of the thread rolling die. Next, the spline starts to be formed by rolling onto the second rolled portion of the shaft member by use of the spline rolling die when a depth of the cutting in the first rolled portion of the shaft member by use of the thread rolling die reaches a value of five percent or more and ten percent or less relative to a blank diameter of the first rolled portion.

The method of a fourth aspect of the present invention according to the third aspect uses the thread rolling die including a set of teeth having a roll-up section, a finish section, and a roll-off section, and the spline rolling die including a set of teeth having a roll-up section, a finish section, and a roll-off section. The roll-up section of the spline rolling die is disposed between a start and end of the finish section of the thread rolling die.

In a rolling die of a first aspect of the present invention, a thread rolling die for forming a thread or worm by rolling onto a first rolled portion of a shaft member and a spline rolling die for forming a spline having a small number of teeth onto a second rolled portion of the shaft member by rolling are disposed parallel to each other. When a depth of the cutting in the first rolled portion by use of the thread rolling die reaches a predetermined value relative to a blank diameter of the first rolled portion, the cutting in the second rolled portion by use of the spline rolling die starts. In other words, the formation by rolling using the thread rolling die starts, and after that, the formation by rolling using the spline rolling die starts while continuing the formation by rolling using the thread rolling die. Accordingly, the shaft member is rolled forcibly by a driving source from the thread or worm formed by rolling by use of the thread rolling die. As a result, the shaft member can be advantageously rolled on the spline rolling die.

Pitches of teeth of the spline rolling die are set in accordance with a circumferential length of a rolling diameter of the thread or worm formed by rolling onto the first rolled portion of the shaft member by use of the thread rolling die.

Accordingly, the spline having a small number of teeth whose number is thirteen or less can be advantageously formed onto the second rolled portion of the shaft member by rolling at the same time as the formation of the thread or worm by rolling.

When a timing for starting the cutting in the second rolled portion by use of the spline rolling die is premature after the cutting in the first rolled portion by use of the thread rolling die starts, the engagement between the thread rolling die and shaft member becomes insufficient. Accordingly, the driving power from the thread or worm is insufficient, so that the shaft member cannot be rolled forcibly. As a result, the shaft member cannot be rolled on the spline rolling die properly, reducing the precision of separation of the spline having a small number of teeth.

On the other hand, when the above start timing is too late, a roll-up angle of the spline rolling die needs to be increased to finish the formation of the spline by rolling while the driving power from the thread or worm works. As a result, the rolling load increases, adversely affecting the lifetime of the spline rolling die.

On the other hand, in the present invention, when a depth of the cutting in the first rolled portion by use of the thread rolling die reaches a value of five percent or more relative to a blank diameter of the first rolled portion, the cutting using the spline rolling die starts. Accordingly, the engagement between the thread rolling die and first rolled portion can be ensured sufficiently to ensure the forcible rotation of the shaft member certainly. As a result, the shaft member can be rolled on the spline rolling die properly to ensure the precision of separation of the spline having a small number of teeth.

Further, the cutting using the spline die starts before a depth of the cutting in the first rolled portion by use of the thread rolling die reaches a value of ten percent or more relative to the blank diameter of the first rolled portion. Accordingly, the roll-up angle of the spline rolling die can be inhibited from becoming large unnecessarily. As a result, the rolling load can be inhibited from becoming excessive, and the lifetime of the spline rolling die can be advantageously prolonged.

In the rolling die of a second aspect of the present invention, an end of a roll-up section of the spline rolling die is disposed between a start and end of a finish section of the thread rolling die. Accordingly, in addition to the advantage of the rolling die of the first aspect, the shaft member is rolled properly on the spline rolling die, and the rolling load is suppressed while ensuring the precision of separation of the spline having a small number of teeth. As a result, the lifetime of the spline rolling die can be advantageously prolonged.

In other words, the end of the roll-up section of the spline rolling die is disposed before the end of the finish section of the thread rolling die. Accordingly, the shaft member can be rolled forcibly by use of the roll-up section and finish section of the thread rolling die at least until the formation of the spline by rolling is finished (namely, while the shaft member is rolled on the roll-up section of the spline rolling die). As a result, the shaft member can be rolled on the roll-up section of the spline rolling die properly, and the precision of separation of the spline having a small number of teeth can be ensured.

On the other hand, the end of the roll-up section of the spline rolling die is disposed behind the start of the finish section of the thread rolling die, so that a length of the roll-up section of the spline rolling die is extended sufficiently. Accordingly, the roll-up angle can be inhibited from becoming excessive. As a result, the rolling load can be suppressed, and the lifetime of the spline rolling die can be prolonged.

In a third aspect of the present invention, a method for forming a thread or worm and a spline having a small number of teeth by rolling simultaneously is as follows. The thread or worm start to be formed onto the first rolled portion of the shaft member by rolling by use of the thread rolling die. Next, when a depth of the cutting in the first rolled portion by use of the thread rolling die reaches a predetermined value, the formation onto the second rolled portion by rolling by use of the spline rolling die starts. In other words, the formation by rolling using the thread rolling die starts, and after that, the formation by rolling using the spline rolling die starts while continuing the formation by rolling using the thread rolling die. Accordingly, the shaft member can be rolled forcibly by a driving source from the thread or worm formed by rolling using the thread rolling die. As a result, the shaft member can be advantageously rolled on the spline rolling die.

The pitches of the teeth of the spline rolling die are set in accordance with a circumferential length of the rolling diameter of the thread or worm formed by rolling onto the first rolled portion by use of the thread rolling die. Accordingly, by rolling the shaft member on the spline rolling die, the spline having a small number of teeth whose number is thirteen or less can be advantageously formed by rolling onto the second rolled portion of the shaft member at the same time as the formation of the thread or worm by rolling.

When a timing for starting cutting in the second rolled portion by use of the spline rolling die is premature after the cutting in the first rolled portion by use of the thread rolling die starts, the engagement between the thread rolling die and shaft member becomes insufficient. Accordingly, the shaft member cannot be rolled forcibly because the driving power from the thread or worm is insufficient. As a result, the shaft member cannot be rolled on the spline rolling die properly, reducing the precision of separation of the spline having a small number of teeth.

On the other hand, when the above start timing is too late, the roll-up angle of the spline rolling die needs to be increased to finish the formation of the spline by rolling while the driving power from the thread or worm works. Accordingly, the rolling load increases, adversely affecting the lifetime of the spline rolling die.

On the other hand, in the present invention, when a depth of the cutting in the first rolled portion by use of the thread rolling die reaches a value of five percent or more relative to the blank diameter of the first rolled portion, the cutting using the spline rolling die starts. Accordingly, the engagement between the thread rolling die and first rolled portion can be ensured sufficiently, ensuring the forcible rotation of the shaft member certainly. As a result, the shaft member can be rolled on the spline rolling die properly, and the precision of separation of the spline having a small number of teeth can be ensured.

Further, the cutting using the spline rolling die starts before a depth of the cutting in the first rolled portion by use of the thread rolling die reaches a value of ten percent or more. Accordingly, the roll-up angle of the spline rolling die can be inhibited from increasing unnecessarily. As a result, the rolling load can be inhibited from becoming excessive, and the lifetime of the spline rolling die can be advantageously prolonged.

In a fourth aspect of the present invention, a method for forming a thread or worm and a spline having a small number of teeth simultaneously by rolling is as follows. The end of the roll-up section of the spline rolling die is disposed between the start and end of the finish section of the thread rolling die. Accordingly, in addition to the advantage of the method of the third aspect, the rolling load can be suppressed, and the lifetime of the spline rolling die can be advantageously prolonged, while ensuring the precision of separation of the spline having a small number of teeth by rolling the shaft member on the spline rolling die properly.

In other words, the end of the roll-up section of the spline rolling die is disposed before the end of the finish section of the thread rolling die, so that the shaft member can be rolled forcibly by use of the roll-up section and finish section of the thread rolling die at least until the formation of the spline by rolling is finished (namely, while the shaft member is rolled on the roll-up section of the spline rolling die). Accordingly, the shaft member can be rolled on the roll-up section of the spline rolling die properly, and the precision of separation of the spline having a small number of teeth can be ensured.

On the other hand, the end of the roll-up section of the spline rolling die is disposed behind the start of the finish section of the thread rolling die, so that a length of the roll-up section of the spline rolling die can be extended sufficiently, and the roll-up angle can be inhibited from becoming excessive. Accordingly, the rolling load can be suppressed, and the lifetime of the spline rolling die can be prolonged.

BRIEF DESCRIPTION OF THE DRAWINGS

The invention will be more particularly described with reference to the accompanying drawings, in which.

DESCRIPTION OF THE PREFERRED EMBODIMENTS

Figure 1:
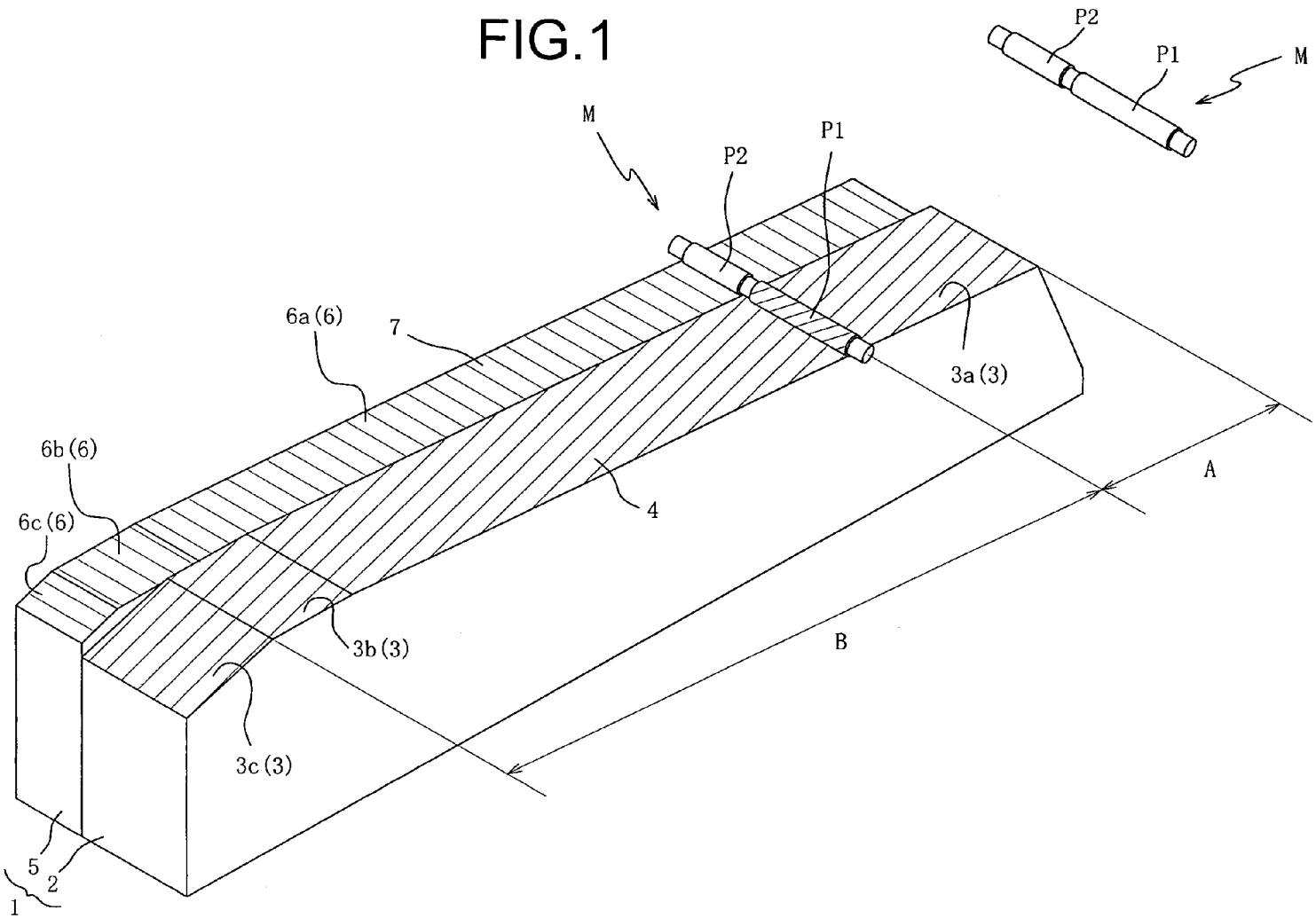
FIG. 1 is a perspective view of a rolling die of one embodiment of the present invention.

Preferred embodiments of the present invention are explained below in reference to the appended drawings. First, an overall structure of rolling dies 1 is schematically explained in reference to FIG. 1. FIG. 1 is a perspective view of the rolling dies 1 of one embodiment of the present invention. In FIG. 1, a rolled material M to be rolled using the rolling dies 1 is virtually shown.

As shown in FIG. 1, by use of the rolling dies 1, an outer peripheral surface of the rolled material M, which is a cylindrical, axial member, is plastically deformed to form a component C (see FIG. 4) having a worm w and a spline s having a small number of teeth through one rolling process simultaneously. Each of the rolling dies 1 has a thread rolling die 2 for forming the worm w by rolling and a spline rolling die 5 for forming the spline s by rolling.

As shown in FIG. 1, the rolled material M has a first rolled portion P1 and a second rolled portion P2 coaxially. The worm w is formed by rolling onto the first rolled portion P1 by use of the thread rolling die 2. The spline s having a small number of teeth whose number is thirteen or less (in this embodiment, the number is ten) is formed by rolling onto the second rolled portion P2 by use of the spline rolling die 5 (see FIG. 4).

The rolling dies 1 have a vertical pair of dies (in FIG. 1, only one of the rolling dies 1 is shown, and another moving relative to and parallel to the one shown is not shown). The rolled material M is rotatably supported between the vertical pair of the rolling dies 1. The rolling dies 1 move relative to each other. Then, the worm w and spline s are formed by rolling simultaneously.

Figure 2:
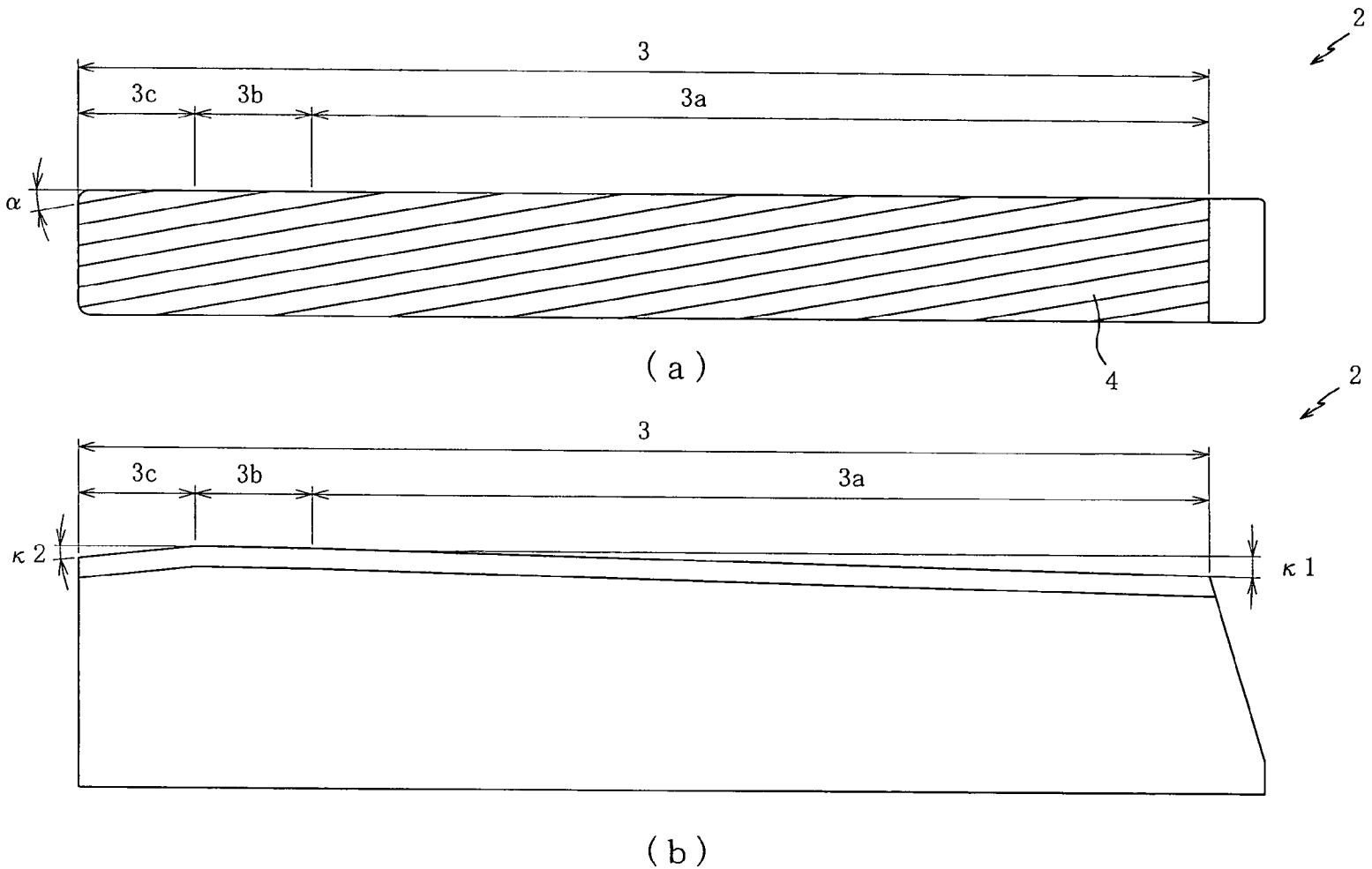
FIG. 2A is a front view of a thread rolling die.
FIG. 2B is a side view of the thread rolling die.

Next, in reference to FIGS. 2A and 2B, a structure of the thread rolling die 2 is explained in detail. FIG. 2A is a front view of the thread rolling die 2. FIG. 2B is a side view of the thread rolling die 2. In FIGS. 2A and 2B, rolling teeth 4 are schematically shown.

As shown in FIGS. 2A and 2B, the thread rolling die 2 is made of a metal such as an alloy tool steel or high speed tool steel suitable for rolling, and has a substantially rectangular parallelepiped shape. On one side of the thread rolling die 2 (on the front side of FIG. 2A, on the upper side of FIG. 2B), a rolling teeth surface 3 is provided for forming the worm w (see FIG. 4) by rolling onto the outer peripheral surface of the first rolled portion P1 (see FIG. 1) of the rolled material M.

As shown in FIGS. 2A and 2B, a roll-up section 3*a*, a finish section 3*b* and a roll-off section 3*c* are successively provided on the rolling teeth surface 3 from a rolling start (the right of FIGS. 2A and 2B) to rolling end (the left of FIGS. 2A and 2B) of the thread rolling die 2.

The roll-up section 3*a* is used for making the rolling teeth surface 3 of the thread rolling die 2 catch the outer peripheral surface of the rolled material M (the first rolled portion P1). The roll-up section 3*a* is used as the so-called roll-up section. As shown in FIG. 2B, the roll-up section 3*a* inclines upward at an inclination angle κ1 from the rolling start (the right of FIGS. 2A and 2B) of the thread rolling die 2 toward the finish section 3*b* (the left of FIGS. 2A and 2B).

The finish section 3*b* is used for finishing the worm w (see FIG. 4) formed by rolling onto the rolled material M (the first rolled portion P1) on the roll-up section 3*a*. As shown in FIG. 2B, the finish section 3*b* is formed substantially parallel to a support surface (bottom surface of FIG. 2B) of the thread rolling die 2.

The roll-off section 3*c* is used for ejecting the rolled material M (first rolled portion P1), which has been finished on the finish section 3*b*, from the rolling teeth surface 3 of the thread rolling die 2. The roll-off section 3*c* is used as the so-called roll-off section. The roll-off section 3*c* inclines downward at an inclination angle κ2 from the end of the finish section 3*b* toward the rolling end (the left of FIG. 2B) of the thread rolling die 2.

The rolling teeth 4 are formed on the rolling teeth surface 3 having the roll-up section 3*a*, finish section 3*b*, and roll-off section 3*c*. The rolling teeth 4 are used for forming the worm w (see FIG. 4). The rolling teeth 4 are formed successively from the start (the right of FIGS. 2A and 2B) of the roll-up section 3*a* toward the end (the left of FIGS. 2A and 2B) of the roll-off section 3*c*.

As shown in FIG. 2A, the rolled teeth 4 are formed to incline at a lead angle α in the longitudinal direction (the left and right direction of FIG. 2A) of the thread rolling die 2 from the start of the roll-up section 3*a* toward the end of the roll-off section 3*c*.

Figure 3:
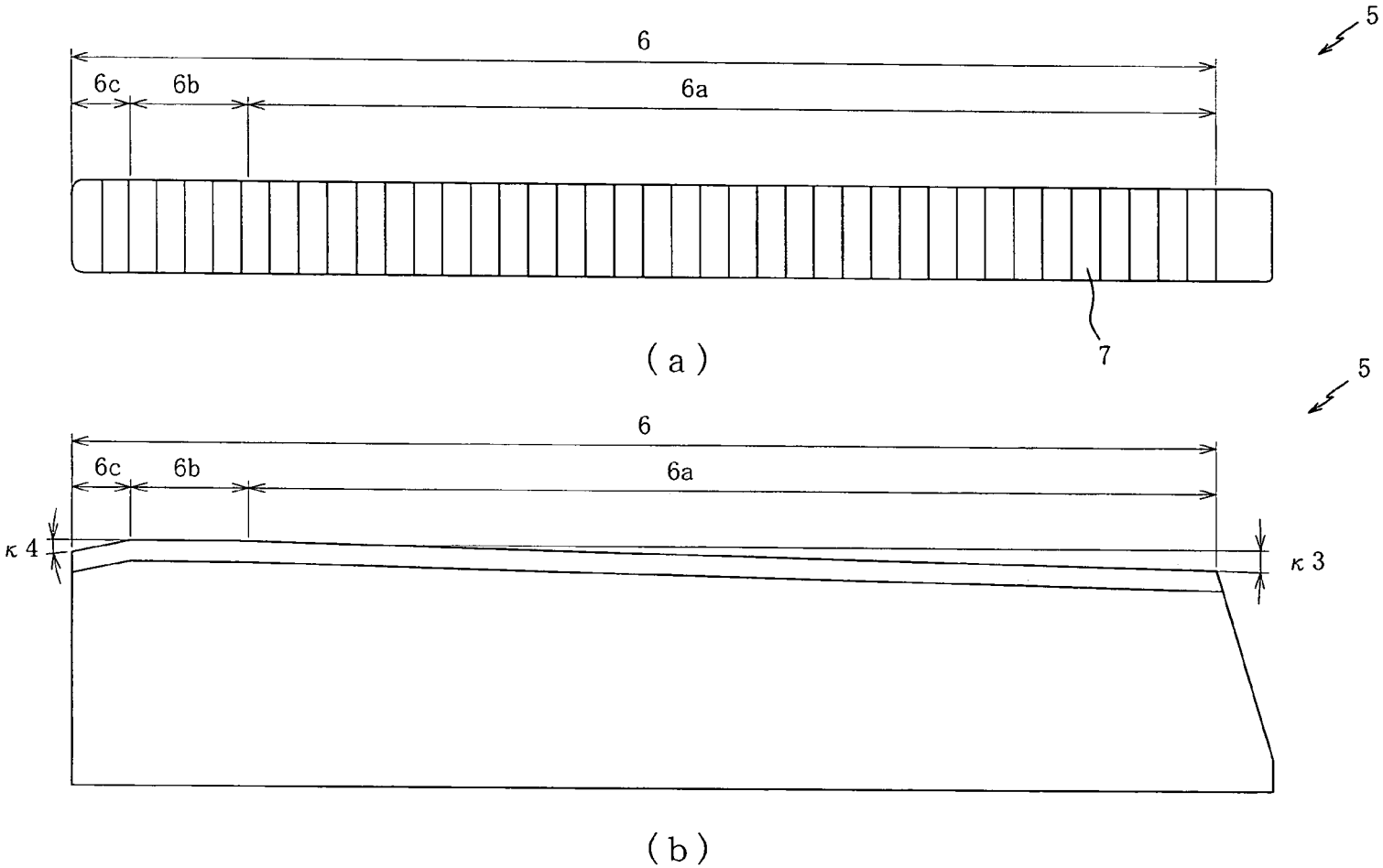
FIG. 3A is a front view of a spline rolling die.
FIG. 3B is a side view of the spline rolling die.

Next, in reference to FIGS. 3A and 3B, the spline rolling die 5 is explained. FIG. 3A is a front view of the spline rolling die 5. FIG. 3B is a side view of the spline rolling die 5. FIG. 3A shows rolling teeth 7 schematically.

A well as the thread rolling die 2, the spline rolling die 5 is made of a metal such as alloy tool steel or high speed tool steel suitable for rolling, and has a substantially rectangular parallelepiped shape. As shown in FIGS. 3A and 3B, a rolling teeth surface 6 for forming the spline s by rolling onto the outer peripheral surface of the rolled material M (the second rolled portion P2) is formed to one side (the front side of FIG. 3A. the top of FIG. 3B) of the spline rolling die 5.

As shown in FIGS. 3A and 3B, a roll-up section 6*a*, a finish section 6*b*, and a roll-off section 6*c* are provided successively in this order from the rolling start (the right of FIGS. 3A and 3B) toward end (the left of FIGS. 3A and 3B) of the spline rolling die 5.

The roll-up section 6*a* is used for making the rolling teeth surface 6 of the spline rolling die 5 catch the outer peripheral surface of the rolled material M (second rolled portion P2). The roll-up section 6*a* is used as the so-called roll-up section. As shown in FIG. 3B, the roll-up section 6*a* is formed to incline upward at an inclination angle κ3 from the rolling start (the right of FIGS. 3A and 3B) of the spline rolling die 5 toward the finish section 6*b* (the left of FIGS. 2A and 2B).

The finish section 6*b* is used for finishing the spline s (see FIG. 4) formed by rolling onto the rolled material M (second rolled portion P2) on the roll-up section 6*a*. As shown in FIG. 3B, the finish section 6*b* is formed substantially parallel to the support surface (the bottom surface of FIG. 3B) of the spline rolling die 5.

The roll-off section 6*c* is used for ejecting the rolled material M (second rolled portion P2), which has been finished on the finish section 6*b*, from the rolling teeth surface 6 of the spline rolling die 5. The roll-off section 6*c* is used as the so-called roll-off section. As shown in FIG. 3B, the roll-off section 6*c* is formed to incline upward at an incline angle κ4 from the end of the finish section 6*b* toward the rolling end (the right of FIG. 3B) of the spline rolling die 5.

The rolling teeth 7 are formed on the rolling teeth surface 6 having the roll-up section 6*a*, finish section 6*b*, and roll-off section 6*c*. The rolling teeth 7 are used for forming the spline s (see FIG. 4), and formed at predetermined pitches from the start (the right of FIGS. 3A and 3B) of the roll-up section 6*a* to the end (the left of FIGS. 3A and 3B) of the roll-off section 6*c*.

The pitches of the rolling teeth 7 are set in accordance with a circumferential length of a rolling diameter of the worm w formed by rolling onto the first rolled portion P1 of the rolled material M by use of the thread rolling die 2. Accordingly, as described later, the rolled material M is rolled forcibly by a driving source from the worm w formed by rolling onto the first rolled portion P1. Then, when the second rolled portion P2 of the rolled material M is rolled on the rolling teeth surface 3 of the spline rolling die 5, the spline s is formed by rolling onto the outer peripheral surface of the second rolled portion P2 of the rolled material M by use of the rolling teeth 7 of the rolling teeth surface 3.

As shown in FIG. 3A, the rolling teeth 7 are formed without torsion relative to the longitudinal direction (the left and right directions of FIG. 3A) of the spline rolling die 5 (namely, the lead angle is almost 90 degrees).

Returning to FIG. 1, the explanation is provided. The rolling dies 1 are structured as follows. As shown in FIG. 1, the thread rolling die 2 and spline rolling die 5 structured as described above are disposed parallel to each other. The cutting in the first rolled portion P1 of the rolled material M is done by use of the thread rolling die 2. When a depth of the cutting reaches a predetermined value (in this embodiment, seven percent) relative to a blank diameter of the first rolled portion P1, the cutting in the second rolled portion P2 of the rolled material M by use of the spline rolling die 5 starts.

In other words, by use of the rolling dies 1, the formation by rolling using the thread rolling die 2 starts (in a section A of FIG. 1), and a depth of the cutting in the first rolled portion P1 of the rolled material M reaches a predetermined value (a border between the section A and a section B of FIG. 1). Then, the formation by rolling using the spline rolling die 5 starts (in the section B of FIG. 1) while continuing the formation by rolling using the thread rolling die 2.

Accordingly, the rolled material M can be rolled forcibly by the driving source from the worm w formed by rolling onto the first rolled portion P1 by use of the thread rolling die 2. As a result, the second rolled portion P2 of the rolled material M can be rolled on the rolling teeth surface 6 of the spline rolling die 5.

As described above, the pitches of the rolling teeth 7 formed on the rolling teeth surface 6 of the spline rolling die 5 are set in accordance with a circumferential length of the rolling diameter of the worm w formed by rolling onto the first rolled portion P1 of the rolled material M by use of the thread rolling die 2.

Figure 4:
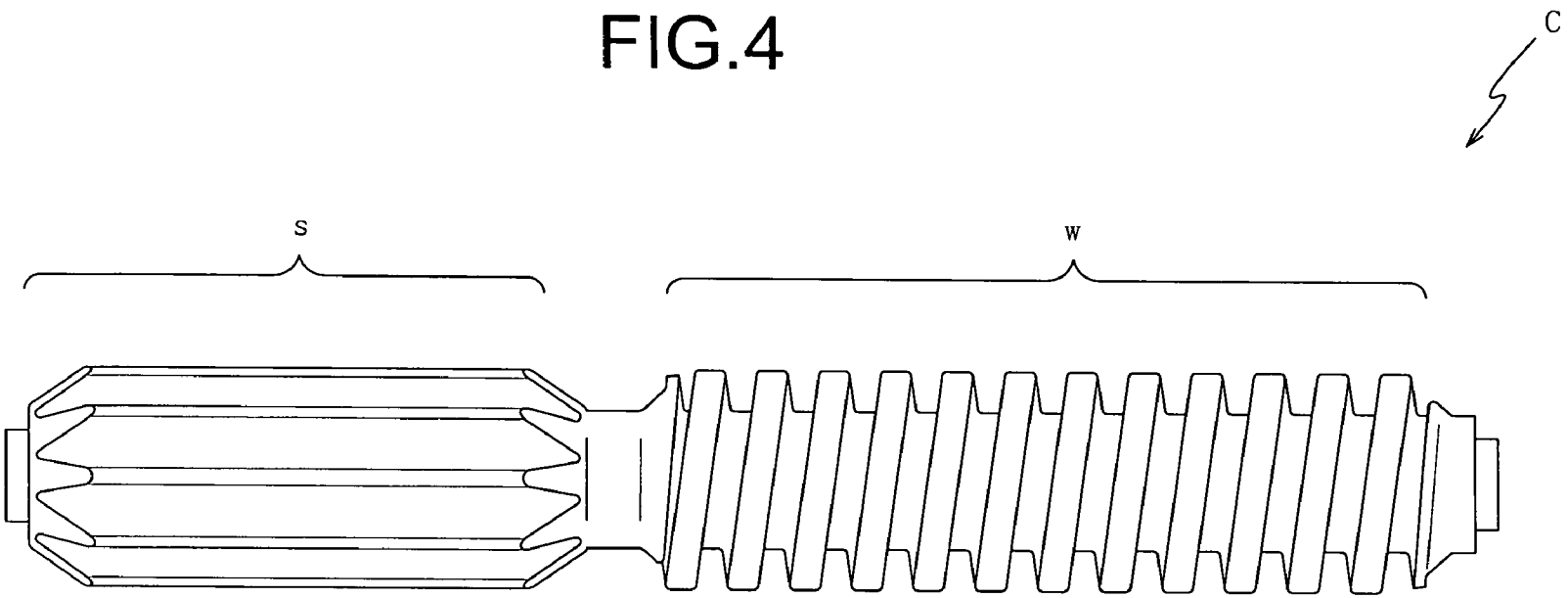
FIG. 4 is a front view of a component having a worm and spline.

Accordingly, the second rolled portion P2 of the rolled material M is rolled on the rolling teeth surface 6 of the spline rolling die 5, so that the spline s having a small number of teeth whose number is thirteen or less (ten teeth in this embodiment) can be formed onto the second rolled portion P2 of the rolled material M by rolling at the same time as the formation of the worm w by rolling (see FIG. 4).

When a timing for starting the cutting in the second rolled portion P2 by use of the spline rolling die 5 is premature (namely, the section A of FIG. 1 is short) after the cutting in the first rolled portion P1 by use of the thread rolling die 2 starts, the engagement between the thread rolling die 2 and rolled material M is insufficient. Accordingly, the rolled material M cannot be rolled forcibly because the driving force from the worm w is insufficient. As a result, the rolled material M cannot be rolled on the rolling teeth surface 6 of the spline rolling die 5, reducing the precision of separation of the splines s.

On the other hand, when the above start timing is too late (namely, the section A of FIG. 1 is longer than the section B of FIG. 1), the roll-up angle (inclination angle) κ3 of the life of the spline rolling die 5 needs to be increased to finish the formation of the splines s by rolling while the driving force from the worm w is effective (namely, until the section B of FIG. 1 ends). Accordingly, the load of the rolling increases, adversely affecting the life of the spline rolling die 5.

The cutting in the second rolled portion P2 of the rolled material M by use of the spline rolling die 5 preferably starts, when the cutting in the first rolled portion P1 of the rolled material M by use of the thread rolling die 2 is done so that a depth of the cutting in the first rolled portion P1 reaches a value of five percent or more and ten percent or less relative to the blank diameter of the first rolled portion P1.

This is because, in the case where the cutting using the spline rolling die 5 starts when a depth of the cutting in the first rolled portion P1 by use of the thread rolling die 2 reaches a value of five percent or more relative to the blank diameter of the first rolled portion P1, the engagement between the thread rolling die 2 and first rolled portion P1 is ensured sufficiently. Accordingly, the rolled material M can be rolled forcibly and certainly. As a result, the rolled material M (the second rolled portion P2) can be rolled on the rolling teeth surface 6 of the spline rolling die 5 properly, and the precision of separation of the spline s can be ensured.

Additionally, when the cutting using the spline rolling die 5 starts before a depth of the cutting in the first rolled portion P1 by use of the thread rolling die 2 reaches a value of ten percent or more relative to the blank diameter of the first rolled portion P1, the roll-up angle (inclination angle) κ3 of the spline rolling die 5 can be inhibited from becoming large unnecessarily. As a result, the excessive rolling road is suppressed, and the lifetime of the spline rolling die 5 can be prolonged.

The blank diameter of the first rolled portion P1 means the diameter of the first rolled portion P1 before the rolling. For example, the fact that a depth of the cutting in the first rolled portion P1 is five percent relative to the blank diameter of the first rolled portion P1 means that the first rolled portion is cut by the rolling teeth 4 P1 by five percent relative to the diameter of the first rolled portion P1 (two point five percent relative to one side of the diameter).

As shown in FIG. 1, the end of the roll-up section 6*a* of the spline rolling die 5 is preferably disposed between the start and end of the finish section 3*b* of the thread rolling die 2. This is because the lifetime of the spline rolling die 5 can be prolonged by rolling the rolled material M (second rolled portion P2) on the spline rolling die 5 (the rolling teeth surface 6) properly, by ensuring the precision of separation of the spline s, and by suppressing the rolling load on the rolling teeth 7.

Concretely, as shown in FIG. 1, the end of the roll-up section 6*a* of the spline rolling die 5 is disposed before the end of the finish section 3*b* of the thread rolling die 2. Accordingly, at least until the formation of the spline by rolling is finished (namely, while the second rolled portion P2 of the rolled material M is rolled on the roll-up section 6*a* of the spline rolling die 5), the rolled material M can be rolled forcibly by use of the roll-up section 3*a* and finish section 3*b* of the thread rolling die 2. As a result, the rolled material M can be rolled on the roll-up section 6*a* of the spline rolling die 5 properly, and the precision of separation of the spline s can be ensured.

On the other hand, as shown in FIG. 1, the end of the roll-up section 6*a* of the spline rolling die 5 is disposed behind the start of the finish section 3*b* of the thread rolling die 2. Accordingly, a length of the roll-up section 6*a* of the spline rolling die 5 can be extended efficiently, and the roll-up angle (inclination angle) κ3 is inhibited from becoming too large. As a result, the rolling load on the rolling teeth 7 can be suppressed, and the lifetime of the spline rolling die 5 can be prolonged.

Even in the case where, as shown in FIG. 1, the end of the finish section 6*b* of the spline rolling die 5 is disposed behind the end of the finish section 3*b* of the thread rolling die 2, and the rolled material M cannot be rolled forcibly by use of the finish section 3*b* of the thread rolling die 2, the spline s formed by rolling onto the rolled material M is rolled on the finish section 6*b* of the spline rolling die 5 while coming into contact with the rolling teeth 7 repeatedly when the formation of the spline s by rolling has been finished on the roll-up section 6*a* of the spline rolling die 5. Accordingly, the rolled material M (component C) can be ejected from the roll-off section 6*c*.

The present invention has been described above in accordance with the embodiments. The invention is not limited to the above embodiments. It will be obvious to those skilled in the art that various modifications may be made without departing from the scope of the invention.

For example, in the above embodiments, the case where the worm w is formed by rolling by use of the thread rolling die 2 has been explained. Instead of the worm w, a thread may be formed by rolling. The number of the thread or worm is not limited. The number may be one or two or more.

In the above embodiments, the case where each of the worm w and spline s is formed by rolling onto one portion has been explained. The present invention is not limited to this case. For example, at least one of the worm w and spline s may be formed by rolling onto two or more portions.

What is claimed is:

1. A rolling die comprising:

a thread rolling die for forming a thread or a worm by rolling onto a first rolled portion of a shaft member coaxially having the first rolled portion and a second rolled portion; and a spline rolling die for forming a spline having a small number of teeth whose number is thirteen or less onto the second rolled portion of the shaft member by rolling, wherein the thread rolling die and the spline rolling die are disposed parallel to each other, pitches of a set of teeth of the spline rolling die are set in accordance with a circumferential length of a rolling diameter of the thread or the worm formed by rolling onto the first rolled portion of the shaft member by use of the thread rolling die, and cutting in the second rolled portion of the shaft member by use of the spline rolling die starts, when cutting in the first rolled portion of the shaft member by use of the thread rolling die is done so that a depth of the cutting in the first rolled portion reaches a value of five percent or more and ten percent or less relative to a blank diameter of the first rolled portion.

2. The rolling die according to claim 1, wherein a set of teeth of the thread rolling die and the set of the teeth of the spline rolling die include a roll-up section, a finish section, and a roll-off section, respectively, and an end of the roll-up section of the spline rolling die is disposed between a start and an end of the finish section of the thread rolling die.

3. A method for simultaneously forming a thread or a worm and a spline having a small number of teeth whose number is thirteen or less onto a shaft member coaxially by rolling by use of a thread rolling die and a spline rolling die, the method comprising the steps of:

setting pitches of a set of teeth of the spline rolling die in accordance with a circumferential length of a rolling diameter of the thread or the worm formed by rolling onto the shaft member by use of the thread rolling die;

starting forming the thread or the worm by rolling onto a first rolled portion of the shaft member by use of the thread rolling die; and starting forming the spline by rolling onto a second rolled portion of the shaft member by use of the spline rolling die when a depth of cutting in the first rolled portion of the shaft member by use of the thread rolling die reaches a value of five percent or more and ten percent or less relative to a blank diameter of the first rolled portion.

4. The method for simultaneously forming a thread or a worm and a spline having a small number of teeth according to claim 3, further comprising the step of:

using the thread rolling die and the spline rolling die, the thread rolling die including a set of teeth having a roll-up section, a finish section, and a roll-off section, the spline rolling die including the set of the teeth having a roll-up section, a finish section, and a roll-off section, and the roll-up section of the spline rolling die being disposed between a start and an end of the finish section of the thread rolling die.

* * * * *